US011273421B2

(12) United States Patent
Stegemoeller et al.

(10) Patent No.: US 11,273,421 B2
(45) Date of Patent: Mar. 15, 2022

(54) FLUID MANAGEMENT SYSTEM FOR PRODUCING TREATMENT FLUID USING CONTAINERIZED FLUID ADDITIVES

(71) Applicant: Halliburton Energy Services, Inc., Houston, TX (US)

(72) Inventors: Calvin L. Stegemoeller, Duncan, OK (US); Bryan Chapman Lucas, Duncan, OK (US); Chad Adam Fisher, Cache, OK (US); Austin Carl Schaffner, Duncan, OK (US); Wesley John Warren, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 352 days.

(21) Appl. No.: 16/066,393

(22) PCT Filed: Mar. 24, 2016

(86) PCT No.: PCT/US2016/024027

§ 371 (c)(1),
(2) Date: Jun. 27, 2018

(87) PCT Pub. No.: WO2017/164880

PCT Pub. Date: Sep. 28, 2017

(65) Prior Publication Data

US 2019/0009230 A1 Jan. 10, 2019

(51) Int. Cl.
*E21B 21/06* (2006.01)
*B01F 13/10* (2006.01)
(Continued)

(52) U.S. Cl.
CPC ..... *B01F 13/004* (2013.01); *B01F 3/1207* (2013.01); *B01F 13/10* (2013.01);
(Continued)

(58) Field of Classification Search
CPC ..... B01F 13/004; B01F 15/0235; B01F 15/0251; B01F 15/0283; B01F 2215/0081; E21B 21/062; E21B 43/04; E21B 43/267
See application file for complete search history.

(56) References Cited

U.S. PATENT DOCUMENTS 710,611 A 10/1902 Ray
802,254 A 10/1905 Baker et al.
(Continued)

FOREIGN PATENT DOCUMENTS

EP 2937826 A1 10/2015
GB 2066220 A 7/1981
(Continued)

OTHER PUBLICATIONS

International Preliminary Report on Patentability issued in related PCT Application No. PCT/US2016/024027 dated Oct. 4, 2018, 14 pages.

(Continued)

*Primary Examiner* — Tony G Soohoo
(74) *Attorney, Agent, or Firm* — John Wustenberg; Baker Botts L.L.P.

(57) ABSTRACT

An example fluid management system for generating a fluid for a treatment operation may include a mixer and a first portable container disposed proximate to and elevated above the mixer. The first portable container may hold dry chemical additives. A feeder may be positioned below the first portable container to direct dry chemical additives from the first portable container to the mixer. The system may also include a first pump to provide fluid to the mixer from a fluid source.

20 Claims, 7 Drawing Sheets

(51) Int. Cl.

| | |
|---|---|
| ***B01F 15/02*** | (2006.01) |
| ***B01F 3/12*** | (2006.01) |
| ***B01F 13/00*** | (2006.01) |
| *E21B 43/04* | (2006.01) |
| *E21B 43/267* | (2006.01) |

(52) U.S. Cl.

CPC ..... *B01F 15/0222* (2013.01); *B01F 15/0235* (2013.01); *B01F 15/0251* (2013.01); *B01F 15/0283* (2013.01); *E21B 21/062* (2013.01); *B01F 2215/0081* (2013.01); *E21B 43/04* (2013.01); *E21B 43/267* (2013.01)

(56) References Cited

U.S. PATENT DOCUMENTS 917,646 A 4/1909 Newey
1,519,153 A 12/1924 Mitton
1,726,603 A 9/1929 Wallace
1,795,987 A 3/1931 Adams
2,172,244 A 9/1939 Grundler
2,231,911 A 2/1941 Hitt et al.
2,281,497 A 4/1942 Hyson et al.
2,385,245 A 9/1945 Willoughby
2,415,782 A 2/1947 Zademach et al.
2,513,012 A 6/1950 Dugas
2,563,470 A 8/1951 Kane
2,652,174 A 9/1953 Shea
2,670,866 A 3/1954 Glesby
2,678,737 A 5/1954 Mangrum
2,759,737 A 8/1956 Manning
2,802,603 A 8/1957 McCray
2,867,336 A 1/1959 Soldini et al.
3,049,248 A 8/1962 Heltzel et al.
3,083,879 A 4/1963 Coleman
3,151,779 A 10/1964 Rensch et al.
3,203,370 A 8/1965 Haug et al.
3,217,927 A 11/1965 Bale, Jr. et al.
3,318,473 A 5/1967 Jones et al.
3,326,572 A 6/1967 Murray
3,343,688 A 9/1967 Ross
3,354,918 A 11/1967 Coleman
3,380,333 A * 4/1968 Clay ..... B01F 15/00344 86/20.15
3,404,963 A 10/1968 Fritsche et al.
3,410,530 A 11/1968 Gilman
3,432,151 A 3/1969 O'Loughlin et al.
3,467,408 A 9/1969 Regalia
3,476,270 A 11/1969 Cox et al.
3,602,400 A 8/1971 Cooke
3,627,555 A 12/1971 Driscoll
3,698,693 A 10/1972 Poncet
3,785,534 A 1/1974 Smith
3,802,584 A 4/1974 Sackett, Sr. et al.
3,986,708 A 10/1976 Heltzel et al.
4,023,719 A 5/1977 Noyon
4,058,239 A 11/1977 Van Mill
4,089,439 A 5/1978 Dearlove et al.
4,138,163 A 2/1979 Calvert et al.
4,178,117 A 12/1979 Brugler
4,204,773 A 5/1980 Bates
4,248,337 A 2/1981 Zimmer
4,258,953 A 3/1981 Johnson
4,311,395 A 1/1982 Douthitt et al.
4,313,708 A 2/1982 Tiliakos
4,395,052 A 7/1983 Rash
4,398,653 A 8/1983 Daloisio
4,423,884 A 1/1984 Gevers
4,490,047 A 12/1984 Stegemoeller et al.
4,544,279 A 10/1985 Rudolph
4,548,507 A * 10/1985 Mathis ..... B28C 9/00 366/20
4,583,663 A 4/1986 Bonerb
4,626,166 A 12/1986 Jolly
4,701,095 A 10/1987 Berryman et al.
4,802,141 A 1/1989 Stegemoeller et al.
4,806,065 A 2/1989 Holt et al.
4,850,701 A 7/1989 Stegemoeller et al.
4,850,702 A 7/1989 Arribau et al.
4,854,714 A 8/1989 Davis et al.
4,856,681 A 8/1989 Murray
4,900,157 A 2/1990 Stegemoeller et al.
4,919,540 A * 4/1990 Stegemoeller ..... B01F 13/0035 366/132
4,956,821 A 9/1990 Fenelon
4,993,883 A 2/1991 Jones
4,997,335 A 3/1991 Prince
5,036,979 A 8/1991 Selz
5,096,096 A 3/1992 Calaunan
5,114,169 A 5/1992 Botkin et al.
5,149,192 A * 9/1992 Hamm ..... B28C 9/0454 366/134
5,303,998 A 4/1994 Whitlatch et al.
5,339,996 A 8/1994 Dubbert et al.
5,343,813 A 9/1994 Septer
5,375,730 A 12/1994 Bahr et al.
5,401,129 A 3/1995 Eatinger
5,413,154 A 5/1995 Hurst, Jr. et al.
5,426,137 A * 6/1995 Allen ..... B01F 3/1271 366/158.4
5,441,321 A 8/1995 Karpisek
5,443,350 A 8/1995 Wilson
5,445,289 A 8/1995 Owen
5,590,976 A 1/1997 Kilheffer et al.
5,609,417 A * 3/1997 Otte ..... B01F 5/0256 366/137
5,667,012 A 9/1997 Hoover et al.
5,722,552 A 3/1998 Olson
5,772,390 A * 6/1998 Walker ..... G01G 13/024 141/83
5,806,441 A 9/1998 Chung
5,896,883 A 4/1999 Khalatbari et al.
5,913,459 A 6/1999 Gill et al.
5,915,913 A 6/1999 Greenlaw et al.
5,927,356 A 7/1999 Henderson
5,944,470 A 8/1999 Bonerb
5,997,099 A 12/1999 Collins
6,059,372 A 5/2000 McDonald et al.
6,112,946 A 9/2000 Bennett et al.
6,126,307 A * 10/2000 Black ..... B28C 5/003 366/192
6,193,402 B1 * 2/2001 Grimland ..... B01F 3/1221 366/14
6,247,594 B1 6/2001 Garton
6,379,086 B1 4/2002 Goth
6,425,627 B1 7/2002 Gee
6,491,421 B2 12/2002 Rondeau et al.
6,517,232 B1 2/2003 Blue
6,536,939 B1 3/2003 Blue
6,537,015 B2 3/2003 Lim et al.
6,568,567 B2 5/2003 McKenzie et al.
6,622,849 B1 9/2003 Sperling
6,655,548 B2 12/2003 McClure et al.
6,876,904 B2 * 4/2005 Oberg ..... B01F 15/0479 366/17
6,948,535 B2 9/2005 Stegemoeller
6,980,914 B2 12/2005 Bivens et al.
7,008,163 B2 3/2006 Russell
7,086,342 B2 8/2006 O'Neall et al.
7,100,896 B1 9/2006 Cox
7,114,905 B2 10/2006 Dibdin
7,252,309 B2 8/2007 Eng Soon et al.
7,284,579 B2 10/2007 Elgan
7,451,015 B2 11/2008 Mazur et al.
7,475,796 B2 1/2009 Garton
7,500,817 B2 3/2009 Furrer et al.
7,513,280 B2 4/2009 Brashears et al.
7,665,788 B2 2/2010 Dibdin et al.
7,762,281 B2 7/2010 Schuld
7,926,564 B2 4/2011 Phillippi et al.
7,997,213 B1 8/2011 Gauthier et al.
8,387,824 B2 3/2013 Wietgrefe
8,434,990 B2 5/2013 Claussen

(56) References Cited

U.S. PATENT DOCUMENTS

D688,349 S 8/2013 Oren et al.
D688,350 S 8/2013 Oren et al.
D688,351 S 8/2013 Oren et al.
D688,772 S 8/2013 Oren et al.
8,505,780 B2 8/2013 Oren
8,545,148 B2 10/2013 Wanek-Pusset et al.
8,573,917 B2 11/2013 Renyer
8,585,341 B1 11/2013 Oren et al.
8,607,289 B2 12/2013 Brown et al.
8,616,370 B2 12/2013 Allegretti et al.
8,622,251 B2 1/2014 Oren
8,662,525 B1 3/2014 Dierks et al.
8,668,430 B2 3/2014 Oren et al.
D703,582 S 4/2014 Oren
8,827,118 B2 9/2014 Oren
8,834,012 B2 9/2014 Case et al.
8,840,298 B2 9/2014 Stegemoeller et al.
8,887,914 B2 11/2014 Allegretti et al.
RE45,713 E 10/2015 Oren et al.
9,162,603 B2 10/2015 Oren
RE45,788 E 11/2015 Oren et al.
9,248,772 B2 2/2016 Oren
RE45,914 E 3/2016 Oren et al.
9,296,518 B2 3/2016 Oren
9,340,353 B2 5/2016 Oren et al.
9,358,916 B2 6/2016 Oren
9,394,102 B2 7/2016 Oren et al.
9,403,626 B2 8/2016 Oren
9,421,899 B2 8/2016 Oren
9,440,785 B2 9/2016 Oren et al.
9,446,801 B1 9/2016 Oren
9,475,661 B2 10/2016 Oren
9,511,929 B2 12/2016 Oren
9,522,816 B2 12/2016 Taylor
9,527,664 B2 12/2016 Oren
9,580,238 B2 2/2017 Friesen et al.
RE46,334 E 3/2017 Oren et al.
9,617,065 B2 4/2017 Allegretti et al.
9,617,066 B2 4/2017 Oren
9,624,030 B2 4/2017 Oren et al.
9,624,036 B2 4/2017 Luharuka et al.
9,643,774 B2 5/2017 Oren
9,650,216 B2 5/2017 Allegretti
9,656,799 B2 5/2017 Oren et al.
9,669,993 B2 6/2017 Oren et al.
9,670,752 B2 6/2017 Glynn et al.
9,676,554 B2 6/2017 Glynn et al.
9,682,815 B2 6/2017 Oren
9,694,970 B2 7/2017 Oren et al.
9,701,463 B2 7/2017 Oren et al.
9,718,609 B2 8/2017 Oren et al.
9,718,610 B2 8/2017 Oren
9,725,233 B2 8/2017 Oren et al.
9,725,234 B2 8/2017 Oren et al.
9,738,439 B2 8/2017 Oren et al.
RE46,531 E 9/2017 Oren et al.
9,758,081 B2 9/2017 Oren
9,758,993 B1 9/2017 Allegretti et al.
9,771,224 B2 9/2017 Oren et al.
9,783,338 B1 10/2017 Allegretti et al.
9,796,319 B1 10/2017 Oren
9,796,504 B1 10/2017 Allegretti et al.
9,809,381 B2 11/2017 Oren et al.
9,828,135 B2 11/2017 Allegretti et al.
9,840,366 B2 12/2017 Oren et al.
9,969,564 B2 5/2018 Oren et al.
9,988,182 B2 6/2018 Allegretti et al.
10,059,246 B1 8/2018 Oren
10,081,993 B2 * 9/2018 Walker ..... E21B 21/01
10,189,599 B2 1/2019 Allegretti et al.
10,207,753 B2 2/2019 O'Marra et al.
10,287,091 B2 5/2019 Allegretti
10,308,421 B2 6/2019 Allegretti
10,486,854 B2 11/2019 Allegretti et al.
10,518,828 B2 12/2019 Oren et al.
10,604,338 B2 3/2020 Allegretti
2002/0121464 A1 9/2002 Soldwish-Zoole et al.
2003/0159310 A1 8/2003 Hensley et al.
2004/0008571 A1 * 1/2004 Coody ..... C09K 8/68 366/154.1
2004/0031335 A1 2/2004 Fromme et al.
2004/0206646 A1 10/2004 Goh et al.
2004/0258508 A1 12/2004 Jewell
2005/0219941 A1 10/2005 Christenson et al.
2006/0013061 A1 1/2006 Bivens et al.
2007/0014185 A1 1/2007 Diosse et al.
2007/0201305 A1 8/2007 Heilman et al.
2008/0187423 A1 8/2008 Mauchle
2008/0294484 A1 11/2008 Furman et al.
2009/0078410 A1 3/2009 Krenek et al.
2009/0129903 A1 5/2009 Lyons, III
2009/0292572 A1 11/2009 Alden et al.
2009/0314791 A1 12/2009 Hartley et al.
2010/0196129 A1 8/2010 Buckner
2010/0319921 A1 * 12/2010 Eia ..... E21B 21/062 166/305.1
2012/0017812 A1 1/2012 Renyer et al.
2012/0018093 A1 * 1/2012 Zuniga ..... B24B 41/06 156/345.14
2012/0037231 A1 2/2012 Janson
2012/0181093 A1 7/2012 Fehr et al.
2012/0219391 A1 8/2012 Teichrob et al.
2012/0255734 A1 10/2012 Coil et al.
2013/0128687 A1 5/2013 Adams
2013/0135958 A1 5/2013 O'Callaghan
2013/0142601 A1 6/2013 McIver et al.
2013/0206415 A1 8/2013 Sheesley
2013/0284729 A1 10/2013 Cook et al.
2014/0020892 A1 1/2014 Oren et al.
2014/0023463 A1 1/2014 Oren
2014/0023464 A1 1/2014 Oren et al.
2014/0044508 A1 2/2014 Luharuka et al.
2014/0069650 A1 3/2014 Stegemoeller et al.
2014/0076569 A1 3/2014 Pham et al.
2014/0083554 A1 3/2014 Harris
2014/0216736 A1 8/2014 Leugemors et al.
2014/0299226 A1 10/2014 Oren et al.
2014/0305769 A1 10/2014 Eiden, III et al.
2014/0377042 A1 12/2014 McMahon
2015/0003943 A1 1/2015 Oren et al.
2015/0003955 A1 1/2015 Oren et al.
2015/0016209 A1 * 1/2015 Barton ..... E21B 43/267 366/152.1
2015/0183578 A9 7/2015 Oren et al.
2015/0191318 A1 7/2015 Martel
2015/0284194 A1 10/2015 Oren et al.
2015/0353293 A1 12/2015 Richard
2015/0366405 A1 12/2015 Manchuliantsau
2015/0368052 A1 12/2015 Sheesley
2015/0375930 A1 12/2015 Oren et al.
2016/0031658 A1 2/2016 Oren et al.
2016/0039433 A1 2/2016 Oren et al.
2016/0046438 A1 2/2016 Oren et al.
2016/0046454 A1 2/2016 Oren et al.
2016/0068342 A1 3/2016 Oren et al.
2016/0130095 A1 5/2016 Oren et al.
2016/0244279 A1 8/2016 Oren et al.
2016/0264352 A1 9/2016 Oren
2016/0332809 A1 11/2016 Harris
2016/0332811 A1 11/2016 Harris
2017/0021318 A1 1/2017 McIver et al.
2017/0123437 A1 * 5/2017 Boyd ..... G05D 7/0641
2017/0129696 A1 5/2017 Oren
2017/0138134 A1 * 5/2017 Walker ..... B01F 5/0206
2017/0144834 A1 5/2017 Oren et al.
2017/0190523 A1 7/2017 Oren et al.
2017/0203915 A1 7/2017 Oren
2017/0217353 A1 8/2017 Vander Pol et al.
2017/0217671 A1 8/2017 Allegretti
2017/0225883 A1 8/2017 Oren
2017/0240350 A1 8/2017 Oren et al.
2017/0240361 A1 8/2017 Glynn et al.
2017/0240363 A1 8/2017 Oren
2017/0267151 A1 9/2017 Oren

(56) References Cited

U.S. PATENT DOCUMENTS

| | | | |
|---|---|---|---|
| 2017/0283165 | A1 | 10/2017 | Oren et al. |
| 2017/0313497 | A1 | 11/2017 | Schaffner et al. |
| 2017/0327326 | A1 | 11/2017 | Lucas et al. |
| 2017/0334639 | A1 | 11/2017 | Hawkins et al. |
| 2017/0349226 | A1 | 12/2017 | Oren et al. |
| 2018/0257814 | A1 | 9/2018 | Allegretti et al. |
| 2018/0369762 | A1 | 12/2018 | Hunter et al. |
| 2019/0009231 | A1 | 1/2019 | Warren et al. |
| 2019/0111401 | A1 | 4/2019 | Lucas et al. |
| 2020/0062448 | A1 | 2/2020 | Allegretti et al. |
| 2020/0062488 | A1 | 2/2020 | Jacob |

FOREIGN PATENT DOCUMENTS

| | | | |
|---|---|---|---|
| GB | 2204847 | A1 | 11/1988 |
| JP | 2008239019 | A | 10/2008 |
| WO | 2008012513 | A2 | 1/2008 |
| WO | 2013095871 | A1 | 6/2013 |
| WO | 2013142421 | A1 | 9/2013 |
| WO | 2014018129 | A1 | 1/2014 |
| WO | 2014018236 | A2 | 5/2014 |
| WO | 2015119799 | A1 | 8/2015 |
| WO | 2015/160374 | A1 | 10/2015 |
| WO | 2015191150 | A1 | 12/2015 |
| WO | 2015192061 | A1 | 12/2015 |
| WO | 2016044012 | A1 | 3/2016 |
| WO | 2016160067 | A1 | 10/2016 |
| WO | 2017/027034 | A1 | 2/2017 |

OTHER PUBLICATIONS

International Search Report and Written Opinion issued in related PCT Application No. PCT/US2016/024027 dated Nov. 28, 2016, 18 pages.

Office Action issued in related Canadian Patent Application No. 3,008,583 dated Oct. 7, 2019, 3 pages.

Office Action issued in related Canadian Patent Application No. 2,996,055 dated Oct. 2, 2020, 5 pages.

* cited by examiner

FLUID MANAGEMENT SYSTEM FOR PRODUCING TREATMENT FLUID USING CONTAINERIZED FLUID ADDITIVES

CROSS-REFERENCE TO RELATED APPLICATION

The present application is a U.S. National Stage Application of International Application No. PCT/US2016/024027 filed Mar. 24, 2016, which is incorporated herein by reference in its entirety for all purposes.

TECHNICAL FIELD

The present disclosure relates generally to treatment operations for hydrocarbon wells, and more particularly, to a fluid management system for producing treatment fluid using containerized fluid additives.

BACKGROUND

During the drilling and completion of oil and gas wells, various wellbore treatment fluids are used for a number of purposes. For example, high viscosity gels are used to create fractures in oil and gas bearing formations to increase production, and maintain positive hydrostatic pressure in the well while limiting flow of well fluids into earth formations during installation of completion equipment. High viscosity gels and fluids also are used to flow sand into wells during gravel packing operations and as proppant during a hydraulic fracturing operation.

High viscosity gels and fluids and other treatment fluids are normally produced by mixing dry powder and/or granular materials and agents with water in stages. For instance, a first stage may include incorporating one or more chemical fluid additives into a source of water to produce a treatment fluid with pre-determined fluid properties, e.g., viscosity, density, etc. The treatment fluid can then be blended with sand or other granular materials before being pumped into a wellbore.

The chemical fluid additives are normally transported to a well site in a commercial or common carrier tank truck. Once the tank truck is at the well site, the fluid additives must be transferred or conveyed from the tank truck into a supply tank. The fluid additives are usually blown pneumatically from the tank truck into an on-location storage/delivery system (e.g., silo). The storage/delivery system may then deliver the fluid additives onto a conveyor or into a hopper connected to a mixing apparatus. This process can be time-consuming and difficult in practice, however, as well as lead to large amounts of dust and noise generation due to the turbulent nature to pneumatic transfer.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
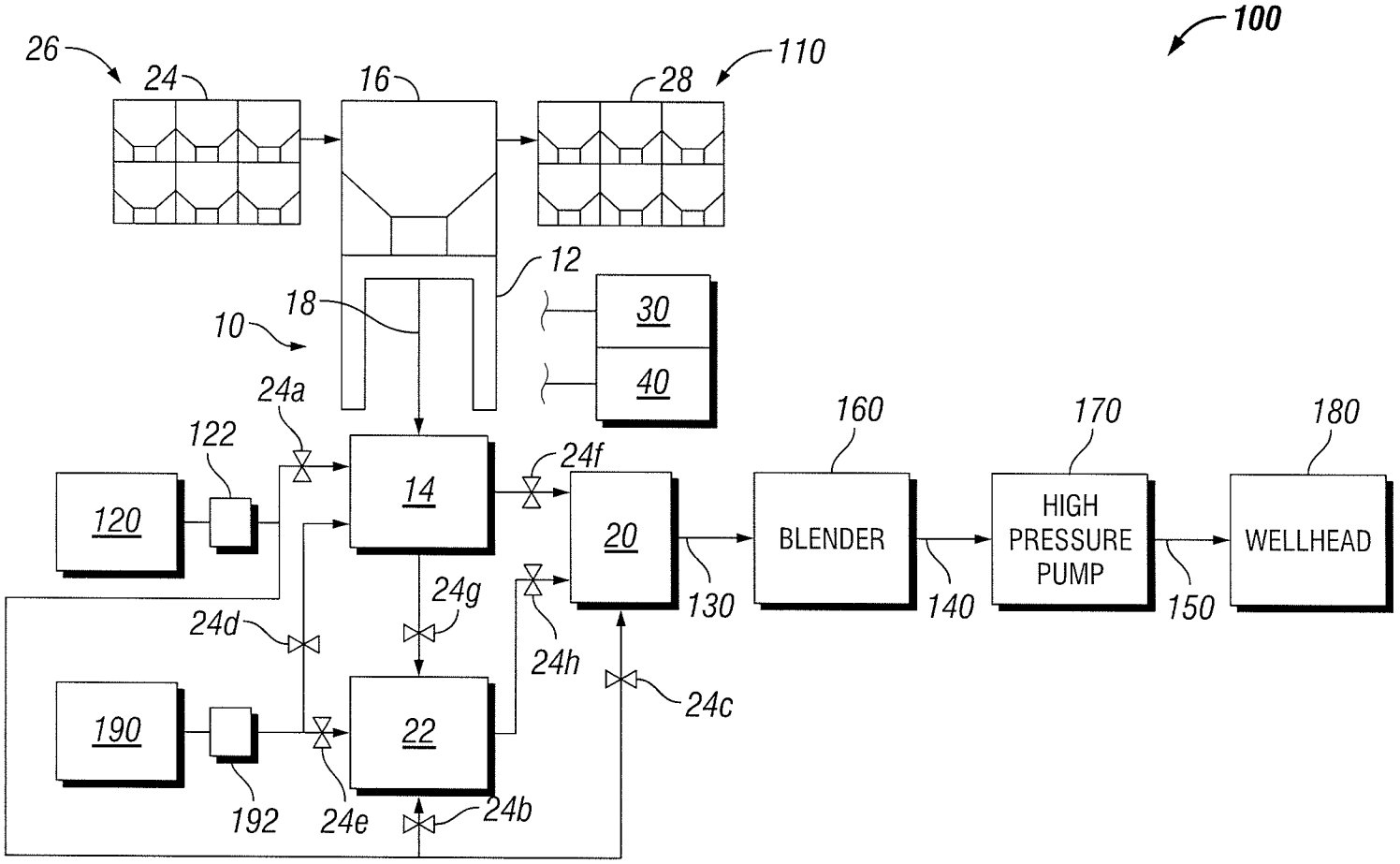
FIG. 1 is a diagram illustrating an example system for treatment operations, according to aspects of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

To facilitate a better understanding of the present disclosure, the following examples of certain embodiments are given. In no way should the following examples be read to limit, or define, the scope of the invention. Certain embodiments according to the present disclosure may be directed to systems and methods for efficiently managing fluid additives and the production of treatment fluid. Fluid additive handling systems are used in a wide variety of contexts including, but not limited to, drilling and completion of oil and gas wells, concrete mixing applications, agriculture, and others. The disclosed embodiments are directed to a fluid management system and associated methods for efficiently utilizing fluid additives for the production of treatment fluid for use in a hydrocarbon-producing well.

The terms "couple" or "couples" as used herein are intended to mean either an indirect or a direct connection. Thus, if a first device couples to a second device, that connection may be through a direct connection, or through an indirect mechanical or electrical connection via other devices and connections. The term "fluidically coupled" or "in fluid communication" as used herein is intended to mean that there is either a direct or an indirect fluid flow path between two components.

In existing treatment operations, dry chemical fluid additives (e.g., gel powder, diverter material, fluid loss material, and friction reducer material) may be transported to a job site in sacks or tanker trucks, where the dry additives are then transferred directly from the tanker trucks to fixed on-site storage containers using pneumatic conveyors or other transfer mechanisms. The transfer mechanisms can cause some of the dry additives or particulates from the dry additives to disperse into the air. The present disclosure facilitates the transfer and use of dry chemical fluid additives within pre-filled, portable containers in a mixing process to produce treatment fluid. For instance, instead of a pneumatic transfer process to move dry additives from a transportation unit to a mixing unit, the transportation unit may deliver one or more containers of dry additives to the well site, where the containers may then be arranged on a platform (e.g., stand, rack structure) around a fluid management system that performs one stage of the mixing process. The fluid management system may include structures to accommodate one or more containers such that a metered flow of dry additives can be provided directly into a mixer to produce a treatment fluid with pre-determined fluid properties.

FIG. 1 is a diagram illustrating an example system 100 for treatment operations, according to aspects of the present disclosure. The system 100 includes a fluid management system 110 in fluid communication with a blender system 160. The blender system 160 may in turn be in fluid communication with one or more high pressure pumps 170, which are in turn in fluid communication with a wellhead 180. In use, the fluid management system 110 may receive water or another fluid from a fluid source 120 (e.g., a ground water source, a pond, one or more frac tanks) mix one or more fluid additives into the received water or fluid produce a treatment fluid with a desired fluid characteristic, and provide the produced treatment fluid 130 to the blender system 160. The blender system 160 may receive the produced treatment fluid 130 from the fluid management system 110 and mix the produced treatment fluid with a proppant, such as sand, or another granular material to produce a final treatment fluid 140. The high pressure pumps 170 may then pressurize the final treatment fluid 140 to generate pressurized final treatment fluid 150 that is directed into the wellbore 180. The configuration of system 100 is not intended to be limiting, as equipment, devices, systems, or subsystems may be added to or removed from the system 100.

The fluid management system 110 may comprise one or more mixing units 10. As depicted, the mixing unit 10 includes a container support frame 12 and a mixer 14. The system 110 also includes a portable fluid additive container 16 elevated on the support frame 12 and holding a quantity of dry chemical fluid additives, such as gel powder, diverter material, fluid loss material, and friction reducer material. Although the support frame 12 is shown holding only container 16 in FIG. 1, it should be appreciated that the support frame 12 can be configured to hold a plurality of fluid additive containers, containing one or more types of dry additives. In addition to the support frame 12 used for receiving and holding the container 16, the mixing unit 10 may also include a feeder 18 for directing dry additives from the container 16 to the mixer 14. Example feeders include, but are not limited to, a metering screw and a chute for directing a gravity flow of dry chemical to the mixer 14 in combination with a metering valve. The feeder 18 may provide a controlled flow of dry additives into the mixer 14.

The mixer 14 may be in fluid communication with and receive fluids from the fluid source 120 and from one or more liquid chemical storage tanks 190 of the fluid management system 100. In certain embodiments, the mixer 14 may be in fluid communication with the fluid source 120 through one or more fluid transfer pumps 122 that may direct a controlled flow of fluid (e.g., water) into the mixer 14. Similarly, the mixer 14 may be in fluid communication with the liquid chemical storage tanks 190 through one or more fluid transfer pumps 192 that direct a controlled flow of liquid chemicals (e.g., acid) into the mixer 14. The mixer 14 is not required to be in fluid communication with the fluid source 120 and liquid chemical storage tanks 190 through fluid transfer pumps 122/192, however, as pressurized tanks, gravity, or other transfer configurations can also be used. The received fluid and/or liquid chemicals may then be mixed with the fluid additives from the container 16 to, at least in part, produce treatment fluid 130.

The fluid management system 110 may further comprise at least one pump 20 to transfer the produced treatment fluid 130 from the fluid management system 110 to the blender 160, or to the high pressure pumps 170. As depicted, the at least one pump 20 is in fluid communication with the mixer 14, so that treatment fluid produced by the mixer 14 may be pumped directly to or around the blender system 160 from the fluid management system 110. In certain embodiments, the at least one pump 20 may comprise a booster pump that increases the pressure of the produced treatment fluid 130 as it leaves the fluid management system 110. Additionally, although the pump 20 is shown as distinct from the fluid transfer pumps 122 and 192, the pump 20 may incorporated into a bank of pumps with the transfer pumps 122 and 192 that control the flow of fluid and/or liquid chemicals within the fluid management system 110.

In certain embodiments, the fluid management system 110 may comprise one or more fluid tanks 22 that may receive mixed treatment fluid from the mixer 14 and store it for a period of time. This may be useful, for instance, with respect to certain gel chemical additives which must rest in fluid for a pre-determined period of time, also referred to as "hydrating," before the gel fully incorporates into the treatment fluid. As depicted, the fluid tank 22 is in fluid communication with the mixer 14 to receive "un-hydrated" treatment fluid, and is also in fluid communication within the pump 20 to allow for the "hydrated" treatment fluid, which may comprise produced treatment fluid 130 in certain instances, to be pumped to the blender system 160. In certain embodiments, the fluid tank 22 also may be in fluid communication with the fluid source 120 and the liquid chemical storage tanks 190 through the fluid transfer pumps 122 and 192, respectively, to allow for modifications of fluid within the fluid tanks 22.

As depicted, the fluid management system 110 further comprises a plurality of valves 24*a-h* that provide for selective fluid communication between the associated elements of the fluid management system 110. Valves 24*a-c* may provide selective communication between the fluid source 120/pump 122 and the mixer 14, fluid tank 22, and pump 20, respectively. Valves 24*d* and 24*e* may provide selective communication between the liquid chemical storage tanks 190/pump 192 and the mixer 14 and fluid tank 22, respectively. Valves 24*f* and 24*g* may provide selective communication between the mixer 14 and the pump 20 and fluid tank 22, respectively. Valve 24*h* may provide selective communication between the fluid tank 22 and the pump 20. It should be appreciated that the configuration of valves 24*a-h* and the selective fluid communication they provide are not intended to be limiting. For instance, some may be omitted, extra valves may be included, or the configuration may be changed entirely depending on the configuration of the fluid management system 110. Additionally, in certain embodiments, some or all of the valves 24*a-h* may comprise actuatable valves that open or close in response to commands issued from a control system 40 of the fluid management system 110, which will be described in detail below.

In certain embodiments, the fluid management system 110 may further comprise a power unit 30 electrically coupled to one or more elements of the fluid management system 110, including, but not limited to the mixer 14, the pumps 20/122/192, the feeder 18, and the control system 40.

Example power units include, but are not limited to, engines that supply at least one of hydraulic, mechanical, or electrical power to one or more elements of the fluid management system 110. Example engines include, but are not limited to, diesel-powered, natural-gas-powered, or dual fuel engines. In certain embodiments, one or more turbine generators may be used to generate and supply electrical power to one or more elements of the fluid management system 110.

The control unit 40 may be operatively associated with or otherwise control one or more elements of the fluid management system 110, including, but not limited to the mixer 14, the pumps 20/122/192, and the valves 24*a-h*, and the feeder 18. The control unit 40 may be operatively associated with the one or more elements of the fluid management system 110 through electrical, mechanical, and/or hydraulic means. For instance, to the extent the feeder 18 and pumps 122/192/20 are driven by electric motors (not shown), the control unit 40 may issue electrical control signals for one or more variable speed drives (not shown) associated with the electric motors (not shown) to control when and how the feeder 18 and pumps 122/192/20 operate. Additionally, to the extent the valves 24*a-h* comprise electrically actuatable valves, the control system 40 may issue individual voltage or current signals to the valves 24*a-h* to cause them to open or close.

In certain embodiments, the control unit 40 may include a computing unit that automatically controls or otherwise facilitates control of the fluid management system 110. As used herein, a computing system may comprise any device with a processor and an associated memory device containing processor-executable instructions (e.g., software or firmware) that cause the control unit 40 to perform certain actions. Example computing units include, but are not limited to, desktop computers, laptop computers, and/or tablets. In certain embodiments, the computing unit may be incorporated or otherwise included with hydraulic or mechanical control mechanisms to control the operation of the fluid management system 110.

During treatment operations, one or more full containers 24 may be selectively moved onto the support frame 12 from a staging area 26. The one or more full containers 24 may be selected based, at least in part, on the type of chemical fluid additive it contains. Once the one or more containers 24 are in place, the control unit 40 may issue one or more commands to the pump 122 to cause fluid from the fluid source 120 to enter the mixer 14 at a known rate. Simultaneously, the control unit 40 may trigger the feeder 18 of the mixing unit 10 to introduce chemical fluid additive from the container 16 into the mixer 14 at a rate necessary to produce a fluid with a desired fluid characteristic one mixed in the mixer. The control unit 40 may open the valve 24*g* to allow un-hydrated fluid from the mixer 14 to enter the fluid tank 22 to hydrate appropriately. Also, the control unit 40 may issue one or more commands to the pump 192 to cause liquid chemicals to be introduced into the treatment fluid. Once hydration has occurred, valve 24*h* may be opened, allowing the produced treatment fluid 130 to be pumped by pump 20 to the blender system 160. It should be appreciated that the above process is but one of many potential processes that can be performed with the fluid management system 110 to produce treatment fluid.

As the treatment operation progresses, the chemical fluid additive in the container 16 may be wholly or partially consumed over time by the mixing unit 10 to produce a treatment fluid with the desired fluid characteristics. Once the necessary treatment fluid is produced, the one or more containers may be removed from the frame 12 and placed in the staging area 26 or in a discard area 28, and other containers 24 may be placed on the frame, depending on the type of treatment fluid that is to be produced. In certain embodiments, the containers on the frame 12 may be interchanged while the treatment fluid is being mixed, to ensure that the correct chemical additives are introduced.

The above system may avoid the need to pneumatically transfer the chemical additives by facilitating transfer of the chemicals within a container. Specifically, the system 110 may allow for containers with chemical additives to be delivered directly to a wellsite and used directly from the container without the need to transfer the chemicals to an intermediary storage tanks. As will be described in detail below, the feeder 18 may only need to move the chemicals a short distance from the container to a mixer in order to produce the required treatment fluid, reducing the opportunity for chemical particulates from being released into the air.

Figure 2:
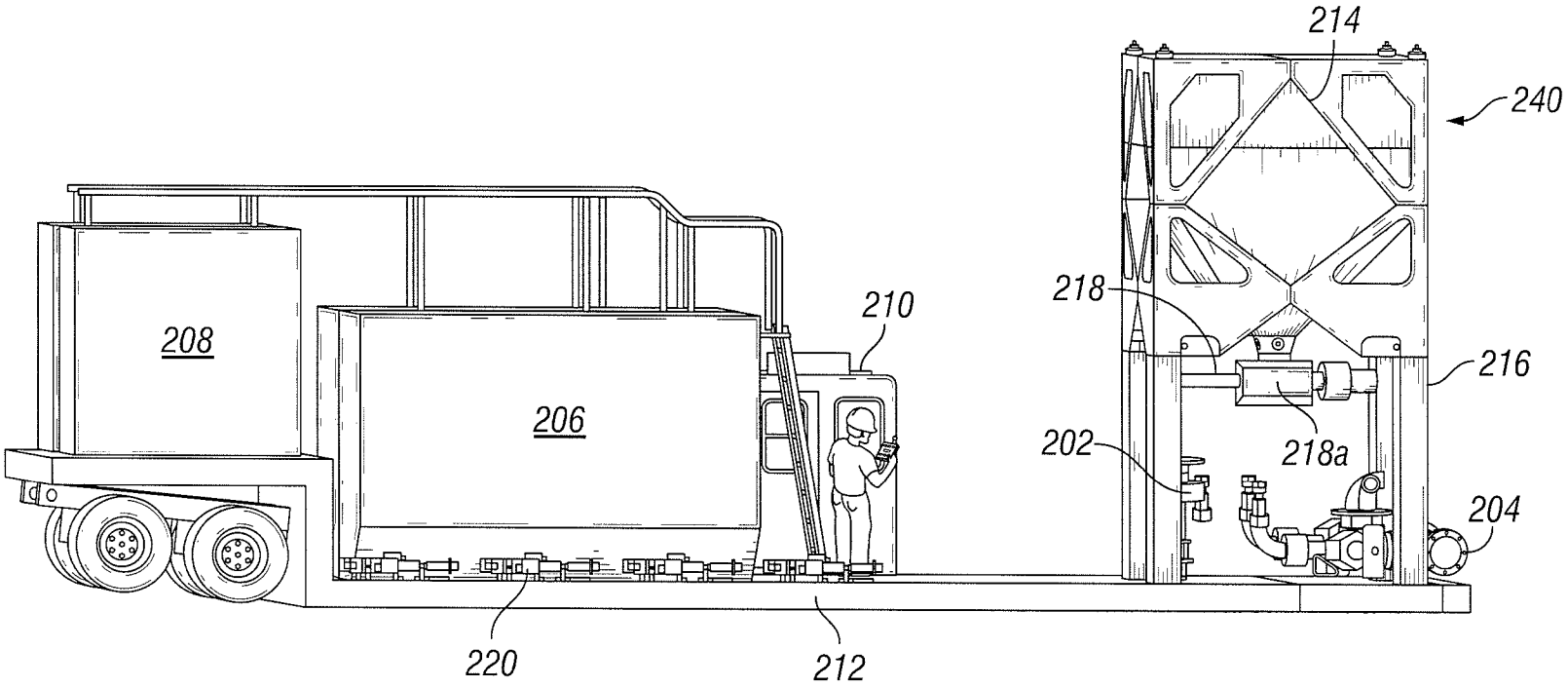
FIG. 2 is a diagram illustrating an example fluid management unit for producing treatment fluids during a treatment operation, according to aspects of the present disclosure.

In certain embodiments, some or all of the elements of the fluid management system 110 may be incorporated into a mobile fluid management unit that can be deployed on-site at a treatment operation. FIG. 2 is a diagram illustrating an example fluid management unit 200 for producing treatment fluids during a treatment operation, according to aspects of the present disclosure. As depicted, the fluid management unit 200 comprises at mixer unit 240, pump 204, fluid tank 206, power unit 208, and control unit 210 deployed on a movable trailer 212. The mixer unit 240 comprises a mixer 202 and a fluid additive container 214 placed on a support frame 216 coupled to the trailer 212. One or more chemical pumps 220 is positioned alongside the fluid tanks 206. Although the system 212 is shown deployed on a trailer 212, it should be appreciated that other movable structures, such as skids, can also be used. Additionally, a plurality of valves, pipes, and other fluid conduits (not shown) may be used to connect the elements of the fluid management unit 200 in a manner similar to the fluid management system described above with respect to FIG. 1.

In the embodiment shown, the pump 204 is positioned at one end of the trailer 212 at least partially within the support frame 216 and under the container 214. Specifically, the mixer 202 is positioned under an output port of a feeder 218 coupled to the support frame 216 and operatively associated with the container 214. By positioning the feeder 218 under the container 214, the system may rely on gravity to move the dry chemical additives from the containers 214 to the feeder 218, where they can be moved to the mixer 202 in a controlled manner. As depicted, the feeder 218 comprises a screw feeder with a hopper 218*a* that receives dry chemical additives from the container 214 before the screw feeder moves the dry chemical additives from the hopper 218*a* to the mixer 202. In this manner, the flow of dry chemical additives from the container 214 may be self-regulating, with additional material only being let out of the container 214 when material is moved from the hopper 218*a*. It should be appreciated, however, that other feeder configurations are possible within the scope of the present disclosure.

As depicted, the mixer 202 comprises a growler mixer that receives dry chemical additives from the feeder 218 through an opening in the top of the mixer 202, and receives fluid from the fluid transfer pump 204 through a fluid port in the side of the mixer 202. Although not shown, the mixer 202 may comprise other fluid inlet and outlet ports that facilitates movement of mixed treatment fluid from the mixer 202 to the fluid tank 206 for hydration, or to a pump (not shown) for pumping produced treatment fluid to a blender system. Although a growler mixer 202 is shown, other types of mixers may be used within the scope of the present disclosure.

As depicted, the power unit 208 and fluid tank 206 are positioned at an opposite end of the trailer 212 from the frame 216, pump 204, and mixer 202. The control unit 210 is positioned between the fluid tank 206 and the pump 202, enclosed within a housing accessible by on-site personnel. The connections between the power unit 208 and the control unit 210 to the equipment located on the trailer 212 are not shown, but can be located at any suitable location on the unit 200.

Figure 3:
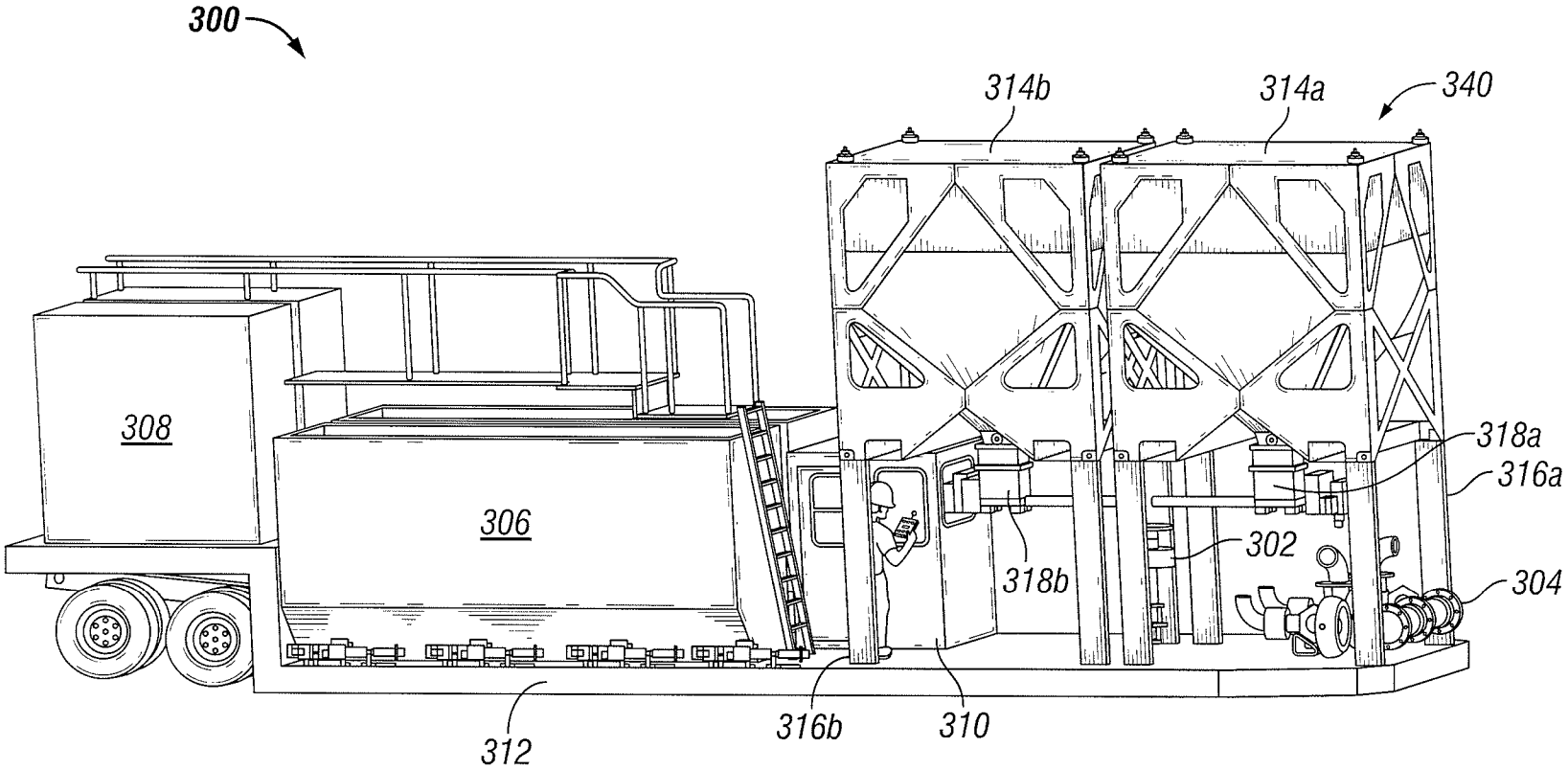
FIG. 3 is a diagram illustrating another example fluid management unit for producing treatment fluids during a treatment operation, according to aspects of the present disclosure.

It should be appreciated that the configuration of the unit 200 may be altered from the depicted configuration depending on the types of equipment used, and still fall within the scope of the present disclosure. For instance, FIG. 3 is a diagram illustrating another example fluid management unit 300 that can accommodate more than one container. As depicted, the unit 300 includes many of the same elements as the unit 200, including, but not limited to, a power unit 308 and fluid tanks 306 at one end of a trailer 312, a pump 304 located at an opposite end of the trailer 312, and a control unit 310 located between the fluid tanks 306 and the pump 304. The unit 300 differs, however, in that a mixer unit 340 includes two frames 316*a* and *b* that accommodate two containers 314*a* and *b*. Although two frames 316*a* and *b* are depicted, it should be appreciated that one larger frame that accommodates multiple containers may be implemented within the scope of this disclosure. Additionally, the unit 300 is not limited to only two containers/frames.

As depicted, each of the frames 316*a/b* include associated feeders 318*a/b* that direct dry chemical fluid additives from the containers 314*a/b* into a shared mixer 202. In this manner, treatment fluids may be mixed using multiple dry chemical fluid additives simultaneously, reducing the number of mixing stages and the time it takes or generate a treatment fluid with the necessary fluid characteristics. The feeders 318*a/b* may, but are not required to, include screw feeders/hoppers similar to the ones described above with respect to FIG. 2, which can provide a metered flow of each additive into the mixer 302. Additionally, although one mixer 302 is shown, multiple mixers may be used.

Figure 4:
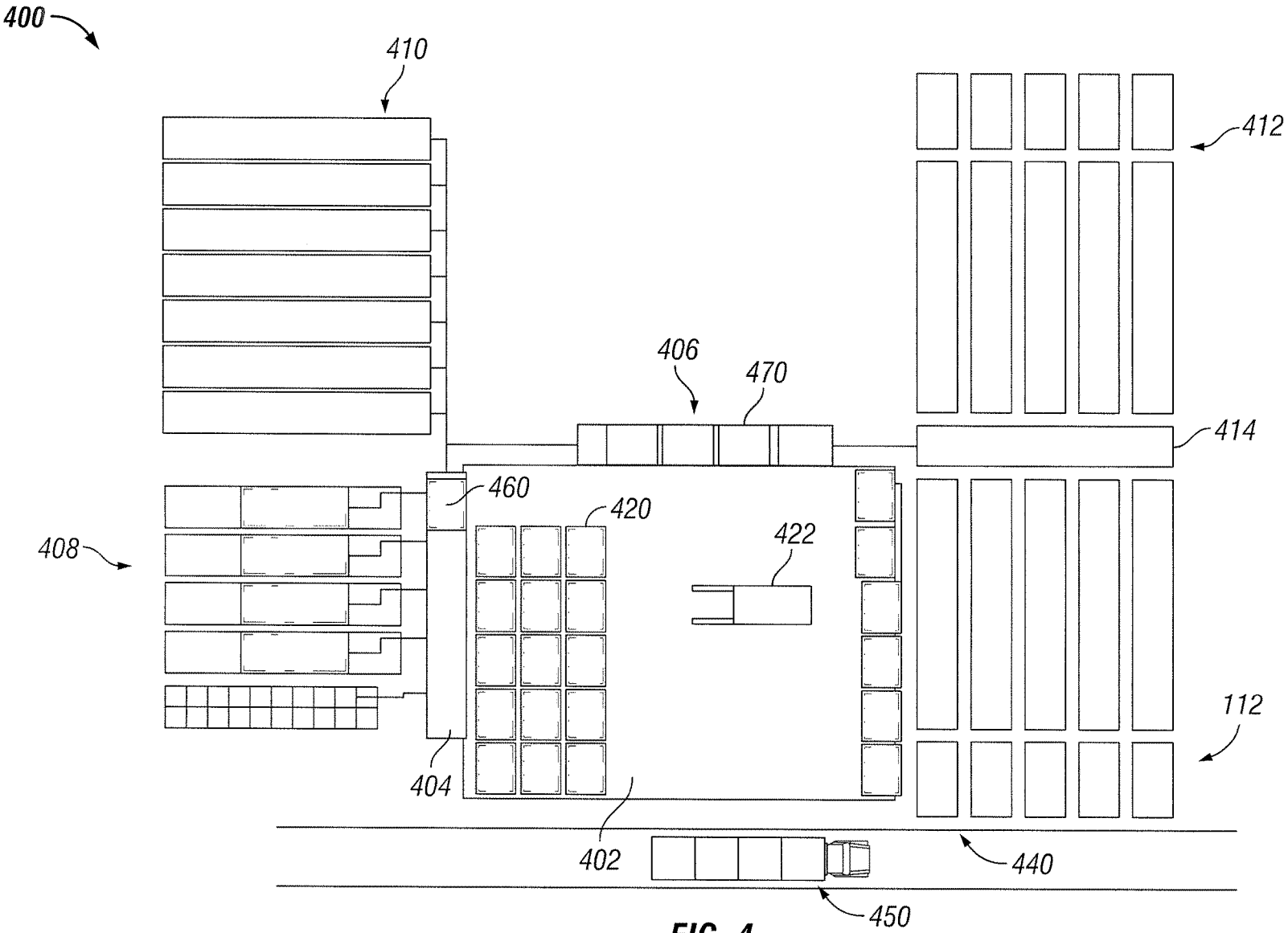
FIG. 4 is a diagram illustrating an example site layout for a treatment operation, according to aspects of the present disclosure.

In certain embodiments, one or more fluid management systems and units similar to the ones described above may be incorporated into a treatment operation that further utilizes the containerization of the dry chemical fluid additives. FIG. 4 is a diagram illustrating an example site layout 400 for a treatment operation, according to aspects of the present disclosure. As depicted, the layout 400 comprises a container staging area 402 around which a fluid treatment unit 404 and a blender unit 406 are positioned. The fluid treatment unit 404 may be in fluid communication with one or more liquid chemical tanks 408 positioned adjacent to the unit 404, as well as a plurality of frac tanks 410 that comprise a fluid source for the treatment operation. The output of the fluid treatment unit 404 may be in fluid communication with the input of the blender unit 406. The output of the blender unit 406 may be in fluid communication with one or more high pressure pumps 412 through a manifold trailer 414, with the one or more high pressure pumps 412 being fluidly connected to a wellbore (not shown).

As depicted, the container staging area 402 may comprise a pad, platform or any other type of structure on which one or more containers 420 of materials for use in the treatment operation are staged. The containers 420 may comprise a plurality of chemical fluid additive containers for use with the fluid management unit, similar to the fluid additive containers described above with respect to FIGS. 1-3. In certain embodiments, the containers 420 also may comprise bulk material containers of sand, proppant, or other granular material for use with the blender unit 406. The container staging area 402 may include devoted areas for each type of container 420 disposed thereon, as well as designated areas for full, empty, and partially used containers.

In the embodiment shown, the layout 400 further comprises a device 422 positioned on the staging area 402 for manipulating the containers 420. Manipulating the containers 420 may include, but is not limited to, loading one or more containers on the fluid management unit 404 and blender unit 406, unloading one or more containers 420 from the fluid management unit 404 and blender unit 406, receiving one or more shipments of containers 420 at the staging area 402, and moving one or more empty containers 420 from the staging area 402. In the embodiment shown, the device 422 comprises a forklift, although other devices, including cranes, hoists, etc. can be used.

As depicted, the fluid management unit 404 and blender unit 406 are accessible from the staging area 402 by the device 422. This may facilitate placement and removal of containers from the fluid management unit 404 and blender unit 406. In certain embodiments, the staging area 402 may also provide access to one or more transportation pathways 440 through which one or more of the containers 420 may be delivered to or removed from the staging area 402. Example transportation pathways include roads, whether paved or unpaved, or other areas dedicated or otherwise intended for use by motorized vehicles, whether permanently, temporarily, or intermittently. As depicted, the transportation pathway 440 provides access to the staging area 402 by a trailer 450. The trailer 450 may transport to the site a load of full containers containing different types of materials, e.g., chemical fluid additives, sand, etc., as well as transport empty containers away from the site.

In use, the trailer 450 may deliver one or more containers to the job site, which are unloaded from the trailer 450 and positioned in the staging area 402 by the device 450. The device 422 may then, for example, retrieve a chemical fluid additive container 460 from the staging area 402 and position it on the fluid management unit 404. The device 422 may also retrieve one or more sand containers 470 from the staging area 402 and position the on the blender unit 406. With the treatment operation underway, the device 422 may load/unload containers from the fluid management unit 404/blender unit 406/truck 450 as is necessary to produce the treatment fluid at the flow rate required by the treatment operation. It should be appreciated, however, that the order in which the containers are loaded and unloaded, and the process generally can be adapted to suit the requirements of a particular treatment operation and still fall within the scope of the present disclosure.

The above described layout 400 may facilitate the transportation and use of containerized materials, including chemical additives, sand, etc., for an entire treatment operation. Specifically, none of the dry materials needed to generate treatment fluid on-site needs to be pneumatically moved to temporary storage tanks. Rather, the materials may be delivered, monitored, and handled in a systematic fashion with the containers. This may reduce particulate matter at the job site as well as lead to a more efficient use of dry materials. Specifically, the containers may allow for the delivery of more precise amounts of dry materials on site than is possible with typical operations.

Figure 5:
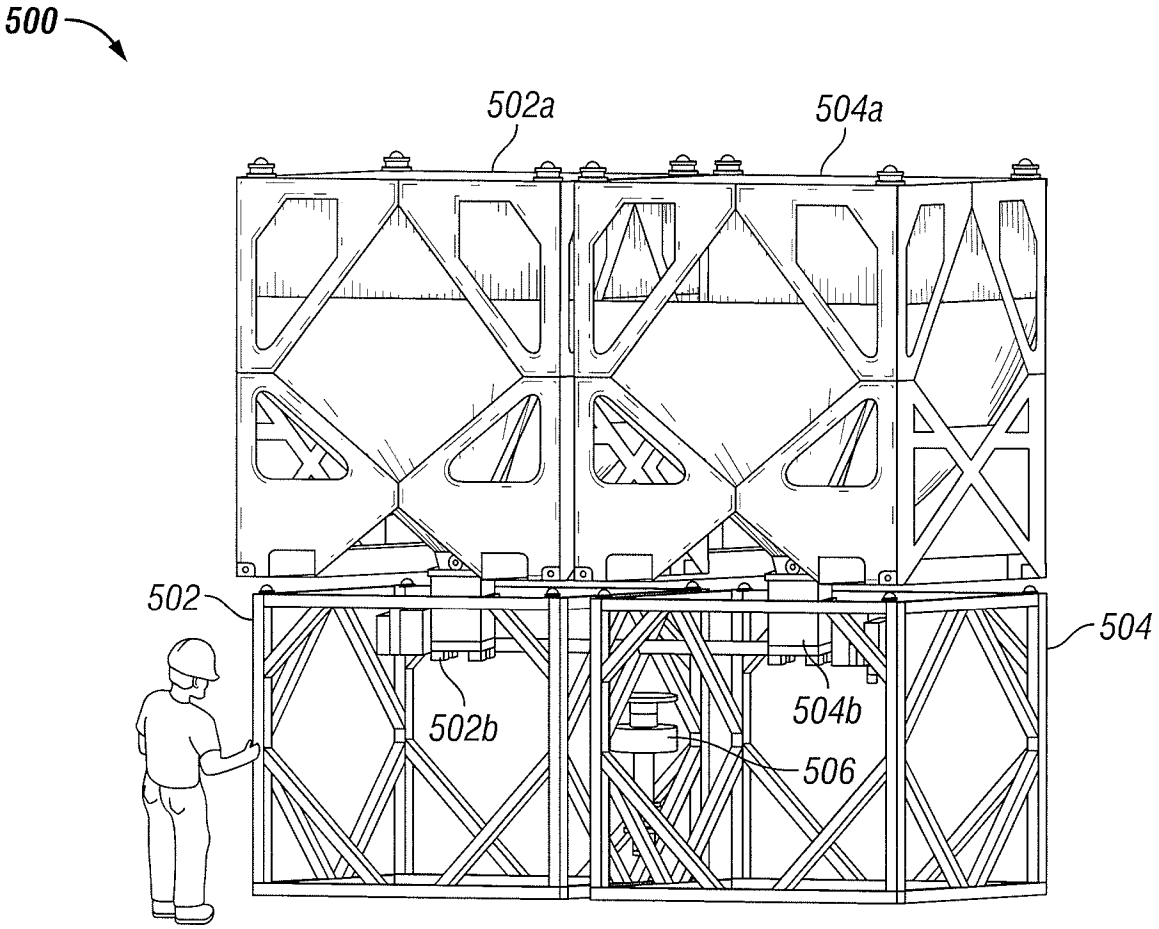
FIG. 5 is a diagram illustrating an example platform, according to aspects of the present disclosure.

In certain embodiments, rather than or in addition deploying the fluid management system on a single movable fluid management unit, similar to the units described above with respect to FIGS. 2 and 3, it may be possible to separately deploy parts of the fluid management system within the scope of this disclosure. For instance, FIG. 5 is a diagram illustrating an example individually-deployed mixing unit 500, according to aspects of the present disclosure. As depicted, the mixing unit 500 comprises platforms 502/504 on which dry chemical containers 502*a* and 504*a* are placed respectively. Similar to the mixing unit configuration described with respect to FIG. 3, the mixing unit 500 may, but is not required to, share a mixer 506 that is fed by feeders 502*b* and 504*b* respectively coupled to platforms 502 and 504. The mixing unit 500 also may, but is not required to, couple to fluid sources, fluid tanks, chemical tanks, and fluid transfer pumps in a manner similar to that described above with respect to FIG. 1.

Figure 6:
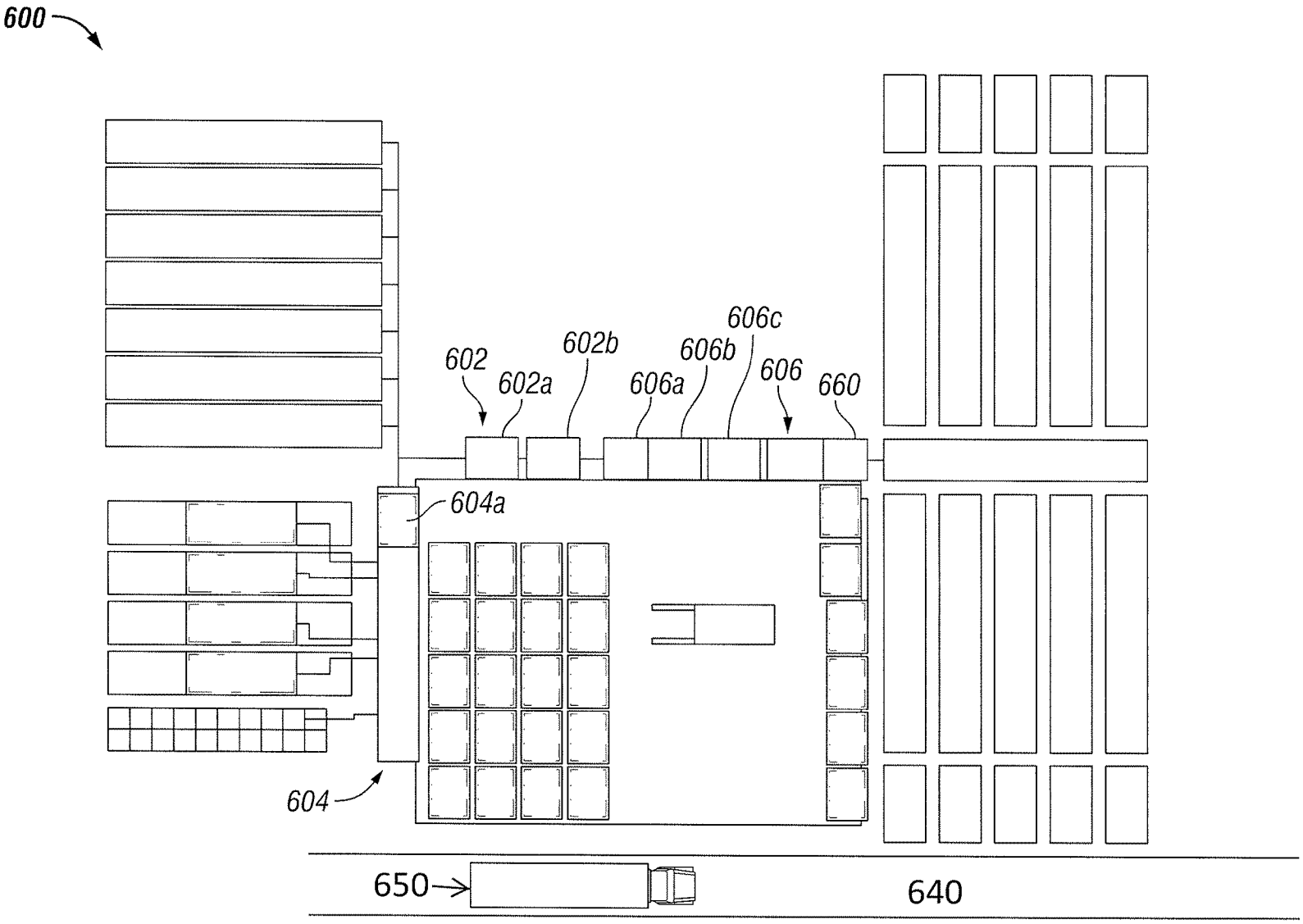
FIG. 6 is a diagram illustrating another example site layout for a treatment operation, according to aspects of the present disclosure.

Notably, the use of an individually-deployed mixing unit may provide flexibility with respect to the design of a fluid management system and any movable fluid management unit including elements of a fluid management system. For instance, FIG. 6 is a diagram illustrating an example site layout 600 similar to the layout illustrated in FIG. 4, except that an individually-deployed mixing unit 602 is positioned between the fluid management unit 604 and the blender unit 606. As depicted, the mixing unit 602 comprises two containers 602*a/b* of chemical additives, with the fluid management unit 604 containing one container 604*a* of chemical additives, providing a total of three potential slots for a dry chemical additive container. As would be appreciated by one or ordinary skill in the art in view of this disclosure, the number and orientation of potential slots for dry chemical additive containers may be changed with nominal alterations in the individually deployed mixing unit 602 itself. This may provide greater flexibility to scale to operation to accommodate the production of more complex treatment fluids without having to retool a fluid management unit with an integrated mixing unit.

Figure 7:
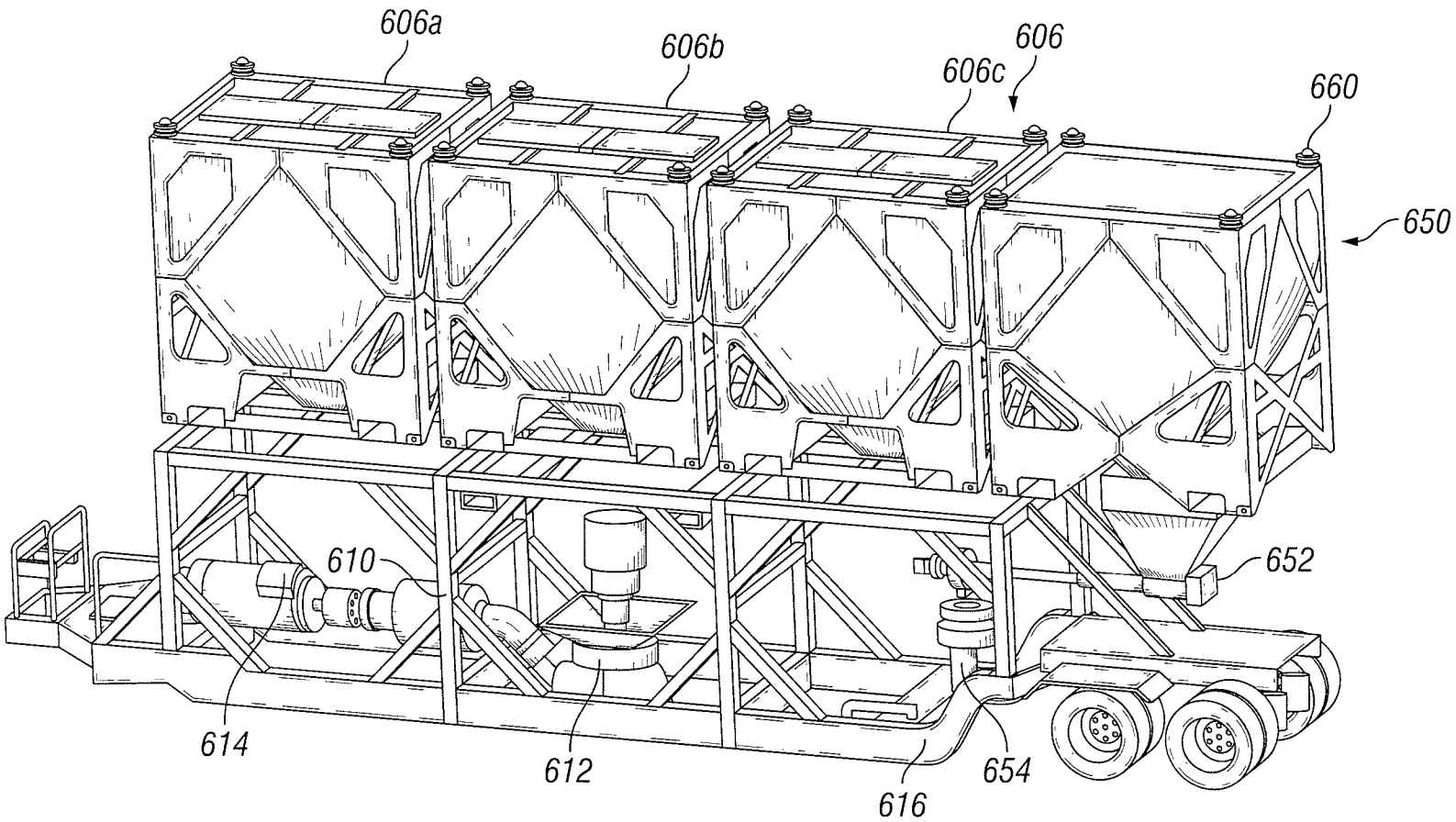
FIG. 7 is a diagram illustrating a blender unit, according to aspects of the present disclosure.

As depicted, the layout 600 further includes a mixing unit incorporated within the blender unit 606, as indicated by the dry chemical container 660 being placed on the blender unit 606 adjacent to sand or proppant containers 606*a-c*. FIG. 7 illustrates a diagram of the blender unit 606 in which the infrastructure associated with the blender unit 606, including a support frame 610, blender tub 612, and fluid pump 614 are positioned on a trailer 616. The mixing unit 650 is incorporated into the blender unit 606 via an extension of the frame 610 to accommodate the placement of the dry chemical container 660. As depicted, the feeder 652 and mixer 654 are positioned at least partially under the dry chemical container 660 in a vacant space on the trailer 616. By placing the mixing unit 650 on the blender unit 606, the system may provide even greater flexibility to scale to operation to accommodate the production of more complex treatment fluids. It should be appreciated, however, that the blender unit configuration depicted in FIG. 7 is not intended to be limiting, and that mixing units with associated dry chemical additive containers may be incorporated into different types of equipment available on site for a treatment operation.

An example fluid management system for generating a fluid for a treatment operation may include a mixer and a first portable container disposed proximate to and elevated above the mixer. The first portable container may hold dry chemical additives. A feeder may be positioned below the first portable container to direct dry chemical additives from the first portable container to the mixer. The system may also include a first pump to provide fluid to the mixer from a fluid source.

In one or more embodiments described in the preceding paragraph, the system may further include a power unit operatively associated with at least the mixer and the feeder.

In one or more embodiments described in the preceding paragraph, the mixer, the first portable container, and the feeder may be positioned on a movable structure.

In one or more embodiments described in the preceding paragraph, a fluid tank may be in fluid communication with the mixer for receiving un-hydrated fluid from the mixer, wherein the fluid tank is positioned on the movable structure.

In one or more embodiment of the preceding four paragraphs, a second portable container may be disposed on the movable structure proximate to and elevated above the mixer or a second mixer and holding dry chemical additives, and a second feeder may be positioned below the second portable container on the movable structure to direct dry chemical additives from the second portable container to the mixer or the second mixer.

In one or more embodiment of the preceding five paragraphs, a second portable container may be deployed on a frame that is separate from the movable structure. The second portable container may be proximate to and elevated above a second mixer and holding dry chemical additives. A second feeder may be positioned below the second portable container on the movable structure to direct dry chemical additives from the second portable container to the second mixer.

In one or more embodiment of the preceding six paragraphs, the system may include a pump for directing fluid from the fluid management system to a blender system.

In one or more embodiment of the preceding seven paragraphs, the dry chemical additive may be at least one of gel powder, diverter material, fluid loss material, and friction reducer material.

In one or more embodiment of the preceding eight paragraphs, the first portable container may be positioned on a frame that is positioned adjacent to a staging area containing a plurality of portable container holding dry chemical additives.

In one or more embodiment of the preceding nine paragraphs, the feeder may include a hopper positioned below an opening of the first portable container, and a screw feed extending from the hopper toward an opening in the mixer.

An example method may include loading a first portable container onto a support frame, wherein the first portable container holds dry chemical additives. The dry chemical additives may be fed from the first portable container to a mixer positioned at least partially below the first portable container. A treatment fluid may be generated within the mixer by mixing the dry chemical additives with a fluid received from a fluid source. The treatment fluid may be directed to at least one of a blending unit and a fluid tank for hydrating the treatment fluid.

In one or more embodiment of the preceding paragraph, the fluid source may include a frac tank in fluid communication with the mixer through a fluid transfer pump.

In one or more embodiment of the preceding two paragraphs, the support frame, the mixer, and the fluid tank may be positioned on a movable structure In one or more embodiment of the preceding three paragraphs, the blending unit and the fluid tank may be deployed on separate structures from the support frame.

In one or more embodiment of the preceding four paragraphs, the support frame and mixer may be positioned on the same structure as the blending unit.

In one or more embodiment of the preceding five paragraphs, loading the first portable container onto the support frame may include loading the first portable container onto the support frame from a staging area comprising a plurality of containers holding dry chemical additives.

In one or more embodiment of the preceding six paragraphs, a second portable container may be loaded onto the blending unit from the staging area, wherein the second portable container holds proppant.

In one or more embodiment of the preceding seven paragraphs, directing the treatment fluid to at least one of the blending unit and the fluid tank for hydrating the treatment fluid may include first directing the treatment fluid to the fluid tank for hydrating the treatment fluid and subsequently directing the hydrated treatment fluid from the fluid tank to the blending unit.

In one or more embodiment of the preceding eight paragraphs, at least one liquid chemical may be received in at least one of the mixer and the fluid tank.

In one or more embodiment of the preceding nine paragraphs, loading the first portable container onto the support frame may include loading the first portable container onto the support frame using a forklift.

Although the present disclosure and its advantages have been described in detail, it should be understood that various changes, substitutions and alterations can be made herein without departing from the spirit and scope of the disclosure as defined by the following claims.

What is claimed is:

1. A fluid management system for generating a fluid for a treatment operation, comprising:

a mixer disposed below a support frame;

a first portable container disposed on the support frame, wherein the first portable container is proximate to and elevated above the mixer and holding dry chemical additives;

a feeder positioned below the first portable container to direct a gravity flow of dry chemical additives from the first portable container directly to the mixer, wherein at least a portion of the feeder is not elevated above the support frame;

a first pump to provide fluid to the mixer from a fluid source; and a power unit configured to generate and provide power;

wherein each of the support frame, the first pump, and the power unit are disposed on a movable structure.

2. The system of claim 1, further comprising a fluid tank in fluid communication with the mixer, wherein one or more chemical pumps are positioned alongside the fluid tank.

3. The system of claim 1, further comprising a blender unit, wherein the blender unit comprises a blender tub disposed on the movable structure.

4. The system of claim 1, wherein the blender unit further comprises a proppant container disposed on the support frame, wherein the proppant container is proximate to and elevated above the blender tub.

5. The system of claim 1, further comprising a second portable container disposed on the movable structure proximate to and elevated above the mixer and holding dry chemical additives; and a second feeder positioned below the second portable container on the movable structure to direct dry chemical additives from the second portable container to the mixer.

6. The system of claim 1, further comprising a second portable container deployed on a frame that is separate from the movable structure, wherein the second portable container is proximate to and elevated above a second mixer and holding dry chemical additives; and a second feeder positioned below the second portable container on the movable structure to direct dry chemical additives from the second portable container to the second mixer.

7. The system of claim 1, further comprising a pump for directing fluid from the fluid management system to a blender system.

8. The system of claim 1, wherein the dry chemical additive comprises at least one of gel powder, diverter material, fluid loss material, and friction reducer material.

9. The system of claim 1, wherein the first portable container is positioned on a frame that is positioned adjacent to a staging area containing a plurality of portable container holding dry chemical additives.

10. The system of claim 1, wherein the feeder comprises a hopper positioned below an opening of the first portable container, and a screw feed extending from the hopper toward an opening in the mixer.

11. A method, comprising:

loading a first portable container onto a support frame, wherein the first portable container holds dry chemical additives;

feeding the dry chemical additives, through a feeder, from first portable container to a mixer disposed below the support frame and the first portable container, wherein at least a portion of the feeder is not elevated above the support frame, wherein a power unit is coupled to at least the mixer and the feeder;

generating a treatment fluid within the mixer by mixing the dry chemical additives with a fluid received from a fluid source through a first pump; and directing the treatment fluid to at least one of a blending unit and a fluid tank for hydrating the treatment fluid, wherein each of the support frame, and the power unit are disposed on a movable structure.

12. The method of claim 11, wherein the fluid source comprises a frac tank in fluid communication with the mixer through a fluid transfer pump.

13. The method of claim 11, wherein the support frame, the mixer, and the fluid tank are positioned on a movable structure.

14. The method of claim 11, wherein the blending unit and the fluid tank are deployed on separate structures from the support frame.

15. The method of claim 11, wherein the support frame and mixer are positioned on the same structure as the blending unit.

16. The method of claim 11, wherein loading the first portable container onto the support frame comprises loading the first portable container onto the support frame from a staging area comprising a plurality of containers holding dry chemical additives.

17. The method of claim 16, further comprising loading a second portable container onto the blending unit from the staging area, wherein the second portable container holds proppant.

18. The method of claim 11, wherein directing the treatment fluid to at least one of the blending unit and the fluid tank for hydrating the treatment fluid comprises first directing the treatment fluid to the fluid tank for hydrating the treatment fluid and subsequently directing the hydrated treatment fluid from the fluid tank to the blending unit.

19. The method of claim 11, further comprising receiving at least one liquid chemical in at least one of the mixer and the fluid tank.

20. The method of claim 16, wherein loading the first portable container onto the support frame comprises loading the first portable container onto the support frame using a forklift.

* * * * *